US005120211A

United States Patent [19]

Ito et al.

[11] Patent Number: 5,120,211

[45] Date of Patent: Jun. 9, 1992

[54] SLIP CASTING DEVICE

[75] Inventors: Haruyuki Ito; Masanobu Hisaeda; Toshiaki Sasaki; Yasuo Hirakawa; Mitsuru Ida, all of Fukuoka, Japan

[73] Assignee: Toto Ltd., Fukuoka, Japan

[21] Appl. No.: 563,415

[22] Filed: Aug. 6, 1990

[30] Foreign Application Priority Data

Aug. 8, 1989 [JP] Japan ..... 1-205390
Aug. 8, 1989 [JP] Japan ..... 1-205391
Aug. 8, 1989 [JP] Japan ..... 1-205393

[51] Int. Cl.[5] ..... B28B 1/26

[52] U.S. Cl. ..... 425/84; 264/86; 425/85; 425/234; 425/338; 425/451; 425/451.9; 425/454

[58] Field of Search ..... 425/84, 85, 88, 234, 425/338, 344, 345, 451, 451.9, 453, 454; 249/113, 126, 137, 141; 264/86, 87

[56] References Cited

U.S. PATENT DOCUMENTS 2,294,476 9/1942 Mooney ..... 425/84
3,189,971 6/1965 Derror ..... 425/453
3,659,994 5/1972 Ehrlich ..... 425/242
3,663,681 5/1972 Ehrlich ..... 264/238
3,742,979 4/1973 Maringer et al. ..... 425/88
4,318,679 3/1982 Moore ..... 249/141
4,798,525 1/1989 Sato et al. ..... 425/85
4,884,959 12/1989 Ito et al. ..... 425/84

FOREIGN PATENT DOCUMENTS 58-208005 12/1983 Japan .
87/02304 4/1987 PCT Int'l Appl. ..... 425/85
1359684 7/1974 United Kingdom .

*Primary Examiner*—James C. Housel
*Attorney, Agent, or Firm*—Irving M. Weiner; Joseph P. Carrier; Pamela S. Burt

[57] ABSTRACT

A slip casting device has a molding station for molding a casting with a mold, and a releasing station separate from the molding station, for separating the casting from mold members of the mold which carry the casting. The device may include a pair of vertically spaced molds and a common clamping cylinder interposed between the pair of molds.

3 Claims, 5 Drawing Sheets 1
10
12b
12a, 12a
12
33
35
30
12d, 12d
32
13, 13
11, 11
3
43
42a
43a
42, 42
41
2
34
12c
14
14a
14b
35
21a
31
34a
43a
42a
40
15
21c
22a, 22a
13a, 13a
50
20
21b
21a
21c
21
22, 22
51
50a

SLIP CASTING DEVICE

BACKGROUND OF THE INVENTION

1. Field of the Invention:

The present invention relates to a slip casting device for manufacturing sanitary ceramic articles.

2. Description of the Relevant Art:

Shaped sanitary ceramic articles, typically flush toilets, are generally manufactured by the slip casting method.

According to the slip casting method, a slip prepared by mixing clay powder with a sufficient amount of water is poured into a mold of either plaster or a water-permeable porous plastic material. The mold absorbs the added water, and the clay is built up on the inner shaping surface of the mold, producing a solid casting which has the inner shape of the mold.

If only a small number of shaped sanitary ceramic articles are to be produced, then molds are assembled manually, the slip is poured into the molds. The molds are subsequently left as they are for a while, and then split to obtain solid castings. Since the cast items thus formed still have a relatively high water content, they are dried, coated with a glaze, and fired.

If shaped sanitary ceramic articles are to be mass-produced, some or most of the above manufacturing steps should preferably be mechanized. One such mechanized slip casting method is disclosed in Japanese Laid-Open Patent Publication No. 58-208005 published Dec. 3, 1983. According to the disclosed slip casting method, upper and lower mold members which are heavy are assembled, clamped, and disassembled to release a cast product, all automatically so that the burden on the worker who handles the slip casting device is minimized. The upper and lower mold members are vertically separable from each other, with the upper mold member being fixed in position by a support post.

When the casting is to be removed from the mold, the lower mold member is separated downwardly while the casting is being attracted under suction by the upper mold member. Then, a feed pallet for supporting the bottom of the casting is moved from one side to a position below the casting. Therefore, the vertical dimension of the slip casting device is relatively large.

Since the upper mold member is fixed in position, it is necessary that the mold members be assembled, the slip be poured, the clay be built up, the extra slip be discharged, the mold be split, and the cast item be released, all in one location. During the slip casting process, particularly when the casting is released, the water and slip flowing out of the mold tend to fall over various device components below the mold. It is difficult to place a simple receptacle for receiving the water and slip below the mold because a complex mechanism for vertically moving the lower mold member is already disposed beneath the mold. As a result, a relatively complex arrangement is required to discharge the water and slip from the mold.

The slip casting device which carries out the disclosed method is complex in structure since the series of operations is effected in one place.

Recently, it has been proposed to tilt or swing the mold in its entirety in order to discharge the slip from the mold cavity efficiently after the clay has been built up on the inner surface of the mold. However, it is impossible to employ the proposed process in the slip casting device disclosed in the above publication since the upper mold member is fixed to the support post which is stationary.

The present invention has been made in an effort to effectively solve the aforesaid problems of the conventional slip casting device.

SUMMARY OF THE INVENTION

It is an object of the present invention to provide a slip casting device which has a relatively simple arrangement for discharging water and extra slip, has relatively small vertical dimensions, and can tilt a mold in its entirety for the efficient discharge of extra slip.

To achieve the above object, there is provided in accordance with the present invention a slip casting device comprising a molding station for pouring a slip into a mold, discharging water in the slip, and building up the clay of the slip on a molding surface of the mold to form a casting, and a releasing station separate from the molding station, for separating the casting from mold members of the mold which carry the casting.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
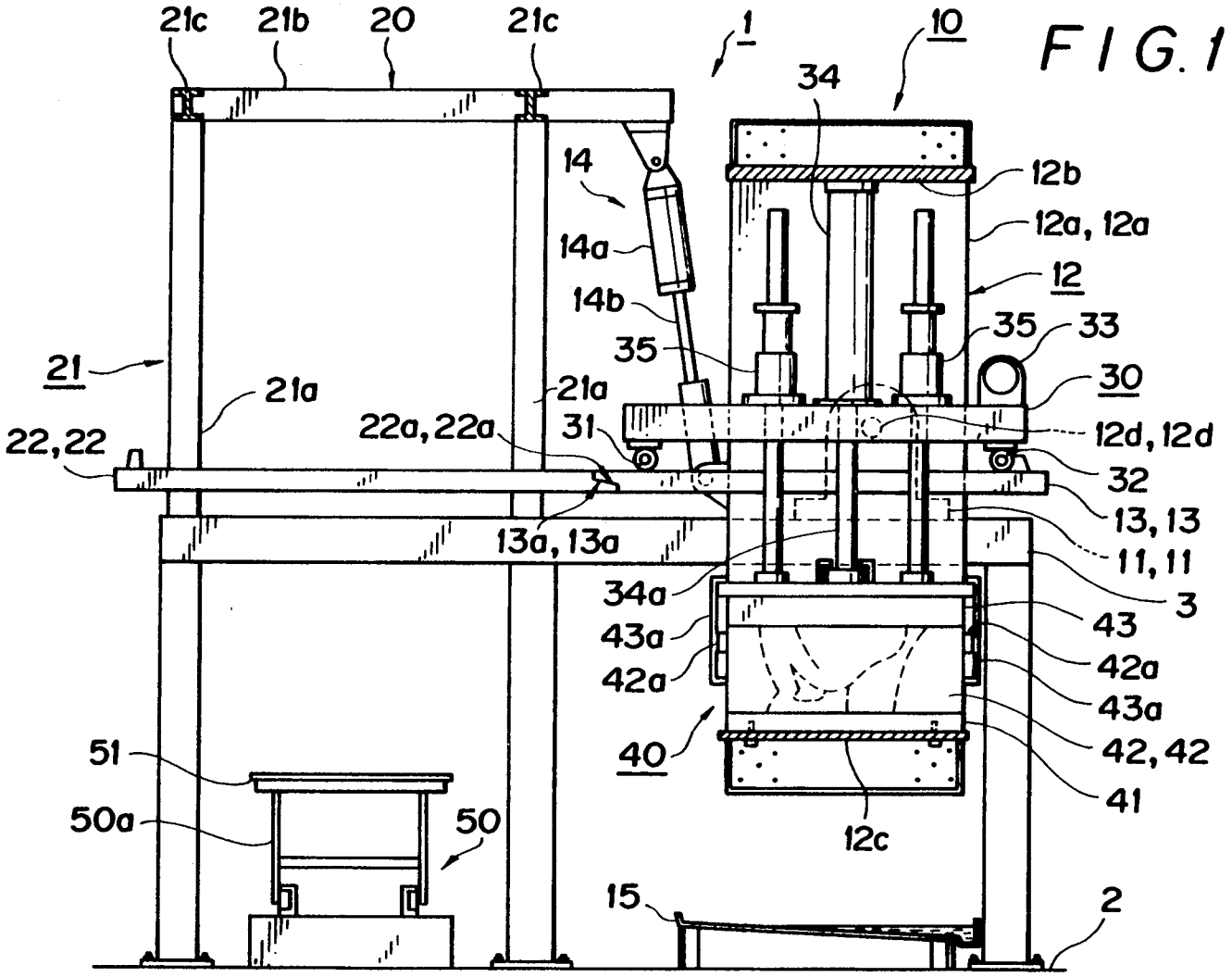
FIG. 1 is a front elevational view of a slip casting device according to a first embodiment of the present invention.

As shown in FIG. 1, a slip casting device, generally designated by the reference numeral 1, according to a first embodiment of the present invention has a molding station 10 and a releasing station 20 which are horizontally spaced from each other, and a mold carriage 30 which is reciprocally movable between the stations 10, 20. Some components of the slip casting device, particularly those on the front side, are omitted from illustration to show the internal structure of the slip casting device 1.

A common table 3 has support posts whose lower ends are bolted to a foundation floor 2. A pair of bearing blocks 11 (only one shown) is mounted on the upper surface of a righthand portion of the table 3. A molding frame 12 in the molding station 10 is supported by the bearing blocks 11.

The molding frame 12 comprises two vertical panels **12*a* and upper and lower horizontal panels 12*b*, 12*c* which interconnect the upper and lower ends, respectively, of the vertical panels 12*a*. The vertical panels 12*a* are horizontally spaced from each other in a direction normal to the sheet of FIG. 1, and have respective shafts 12***d* projecting horizontally and fitted respectively in the bearing blocks 11. The molding frame 12 is laterally open on lefthand and righthand sides (FIG. 1). Two parallel first rails 13 are fixed securely to the frame 12.

A frame 21 in the releasing station is vertically mounted on the upper surface of a lefthand portion of the common table 3. The frame 21 comprises four upright members 21*a* (only two rear upright members shown), two joint members 21*b* (only one shown) which interconnect the upper ends of the rear upright members 21*a* and the upper ends of the front upright members, and two cross members 21*c* which interconnect the joint members 21*b*. The cross members 21*c* make the frame 21 highly rigid in the direction normal to the sheet of FIG. 1. Two parallel second rails 22 are fixed securely to the frame 21, the second rails 22 being contiguous to the first rails 13 when the molding frame 12 is not tilted. The second rails 22 have engaging ends 22*a*, and the first rails 13 also have engaging ends 13*a* which are engageable with the engaging ends 22*a*. These engaging ends 22*a*, 13*a* have complementary end surfaces, so that they are snugly fitted with each other. When the rails 22, 13 are joined to each other, they jointly form a pair of continuous parallel rails. The engaging ends 22*a*, 13*a* of the rails 22, 13 are slanted such that the first rails 13 can be tilted clockwise (FIG. 1) with the frame 12 away from the second rails 22.

A self-propelled carriage 30 for moving a mold is movably mounted on the first rails 13 and the second rails 22. The carriage 30 has two front wheels 31 and two rear wheels 32 which are rollingly mounted on the rails 13, 22, and also has a motor 33 with a speed reducer for reversibly rotating the rear wheels 32. A cylinder unit 34 is vertically mounted on the carriage 30 and has a piston rod 34*a* which extends downwardly through the carriage 30 and is vertically extensible and contractable.

The slip casting device 1 has a slip mold 40 which comprises a lower mold member 41, a pair of left and right side mold members 42, and an upper mold member 43. The slip mold 40 is specially constructed to mold a toilet bowl in the illustrated embodiment. The side mold members 42 are separable away from each other in the direction normal to the sheet of FIG. 1 so that they can mold a toilet bowl. The lower mold member 41 is bolted to the lower horizontal panel 12*c* of the frame 12, whereas the upper mold member 43 is coupled to the lower end of the piston rod-34*a* of the cylinder unit 34. The upper mold member 43 is kept horizontally by guide mechanisms 35 while it is being moved vertically by the piston rod 34*a*. The side mold members 42 have respective projections 42*a* on their outer side surfaces, which are engageable with respective hooks 43*a* extending downwardly from lateral sides of the upper mold member 43. A cylinder 14 for tilting the frame 12 has a cylinder body 14*a* whose upper end is pivotally connected to one of the joint members 21*b*, and a piston rod 14*b* which has a lower end pivotally connected to one of the rails 13. A conveyor 50 is disposed in the releasing station and movable in the direction normal to the sheet of FIG. 1, the conveyor 50 having a pantograph-type lifting mechanism 50*a*.

Figure 2:
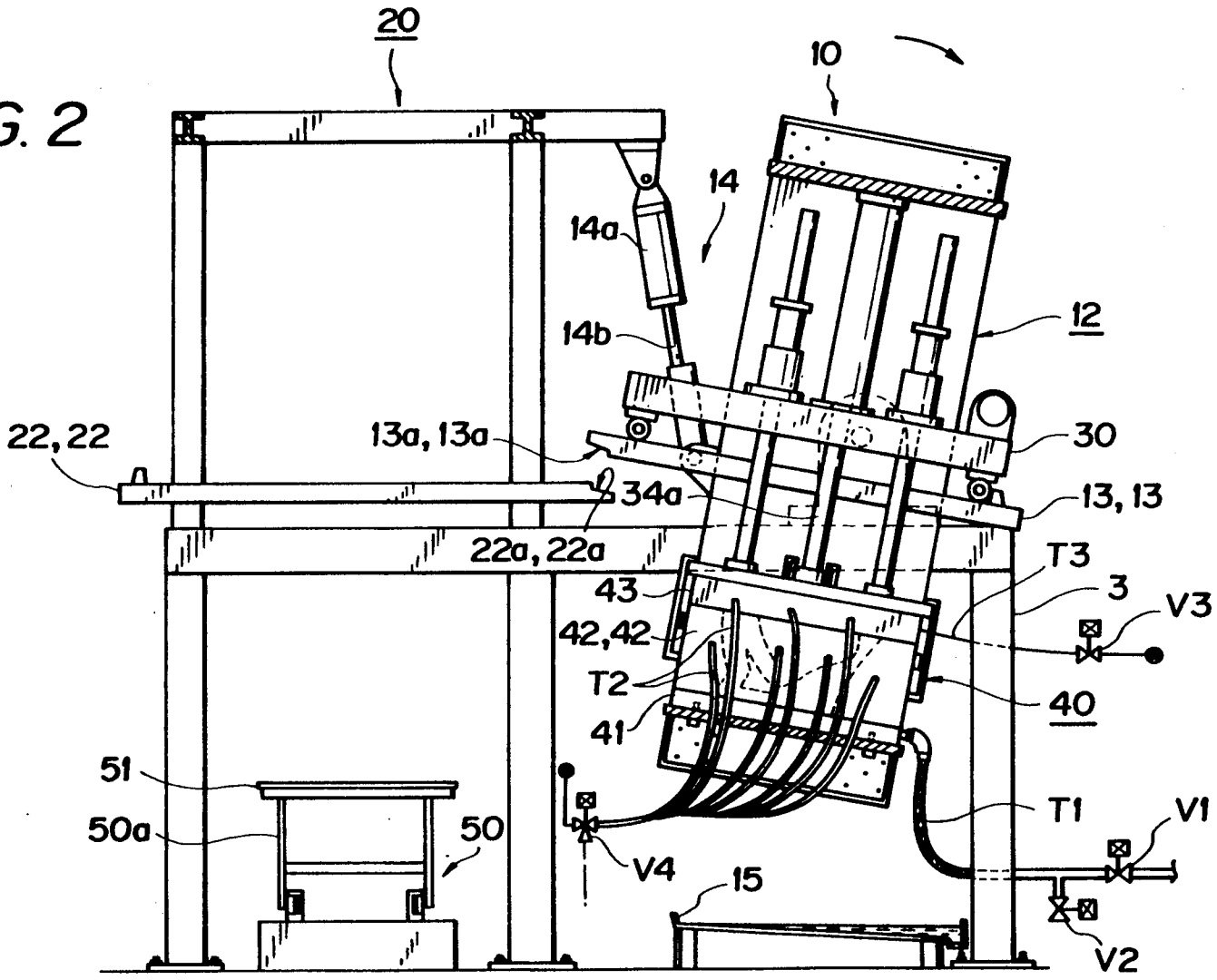
FIG. 2 is a front elevational view showing the manner in which a mold of the slip casting device shown in FIG. 1 is tilted.

The slip casting device 1 thus constructed operates as follows:

First, the cylinder 14 is actuated to contract the piston rod 14*b* for thereby tilting the frame 12 through a predetermined angle (50° or less) into the angular position shown in FIG. 2. When the frame 12 is tilted, the engaging ends 13*a* of the first rails 13 are moved upwardly without physical interference with the engaging ends 22*a* of the second rails 22. Then, a slip discharge valve V2 (FIG. 2) is closed, and a slip supply valve V1 is opened to introduce a slip from a slip source through a slip supply/discharge hose T1 connected to the lowermost portion of the lower mold member 41 into the mold 40. The mold 40 is of a double-layer construction having an outer layer of concrete and an inner layer of a water-permeable porous plastic material, with a number of water passages disposed either between the inner and outer layers or in the inner layer.

The slip is continuously supplied until the inner cavity of the mold 40 is filled up with the supplied slip. Thereafter, the cylinder 14 is actuated again to extend the piston rod 14*b* to tilt back the frame 12 into the position shown in FIG. 1. The engaging ends 13*a* of the first rails 13 are brought into neat engagement with the engaging ends 22*a* of the second rails 22, whereupon the rails 13, 22 jointly make up long straight rails extending through the stations 10, 20. The slip in the mold cavity is pressurized up to a pressure ranging from 5 to 10 atmospheric pressures by a pump or a pressure intensifier (not shown).

Since the inner layer of the mold 40 passes only water therethrough, the clay of the slip is built up on the inner surface of the inner layer, and a solid clay body is gradually formed on the inner layer. The water which has passed through the inner layer flows through the water passages and is discharged through hoses T2 which are connected to the mold members and also through a discharge port of a three-way valve V4. Although only one three-way valve V4 is shown for the sake of brevity, there are actually a plurality of such three-way valves V4 which are connected respectively to the hoses T2.

After elapse of a predetermined period of time, the piston rod 14*b* of the cylinder 14 is contracted again to tilt the frame 12 through a given angle (e.g., 50° or less). Then, the slip supply valve V1 is closed, and the slip discharge valve V2 is opened. A pressurized air valve V3 is opened to supply air under pressure into the mold cavity in the mold 40. Now, any extra slip is discharged under air pressure from the mold 40 through the hose T1. As a result, formed clay casting W which still contains water is left in the mold 40.

After the extra slip has completely been discharged, the slip discharge valve V2 is closed, and air is supplied under pressure into the mold cavity for a prescribed period of time to reduce the water content of the casting W.

Then, the piston rod 14*b* of the cylinder 14 is extended to turn the frame 12 back to the position shown in FIG. 1. Those valves V4 which are associated with the lower mold member 41 and the upper mold member 43 are shifted over to supply a suitable air pressure through the hoses T2 into the water passages in only the lower mold member 41 and the upper mold member 43. The water which has been left in the inner layers of the mold members 41, 43 is caused by the air pressure to ooze out into the interface between the casting W and the inner surface of the mold 40, thus making a water film therebetween. The water film now separates the lower mold member 41 and the upper mold member 43 from the casting W. At this time, however, the side mold members 42 are not yet separated from the casting W. At the same time that the air pressure is applied to the lower mold member 41 and the upper mold member 43, the piston rod 34*a* is contracted to lift the upper mold member 43 which has been separated from the casting W. While the upper mold member 43 is being elevated, the hooks 43*a* extending therefrom engage the respective projections 42*a* on the side mold members 42, and lift the side mold members 42 which still hold the casting W. Since the casting W is also elevated with the side mold members 42, the casting W is separated from the lower mold member 41. Therefore, the side mold members 42 serve to carry the casting W.

Any water and slip which fall from the mating surfaces of the mold 40 when the casting W is partly released from the mold 40, are received by a receptacle 15 which is located in a lower portion of the molding station 10.

Figure 3:
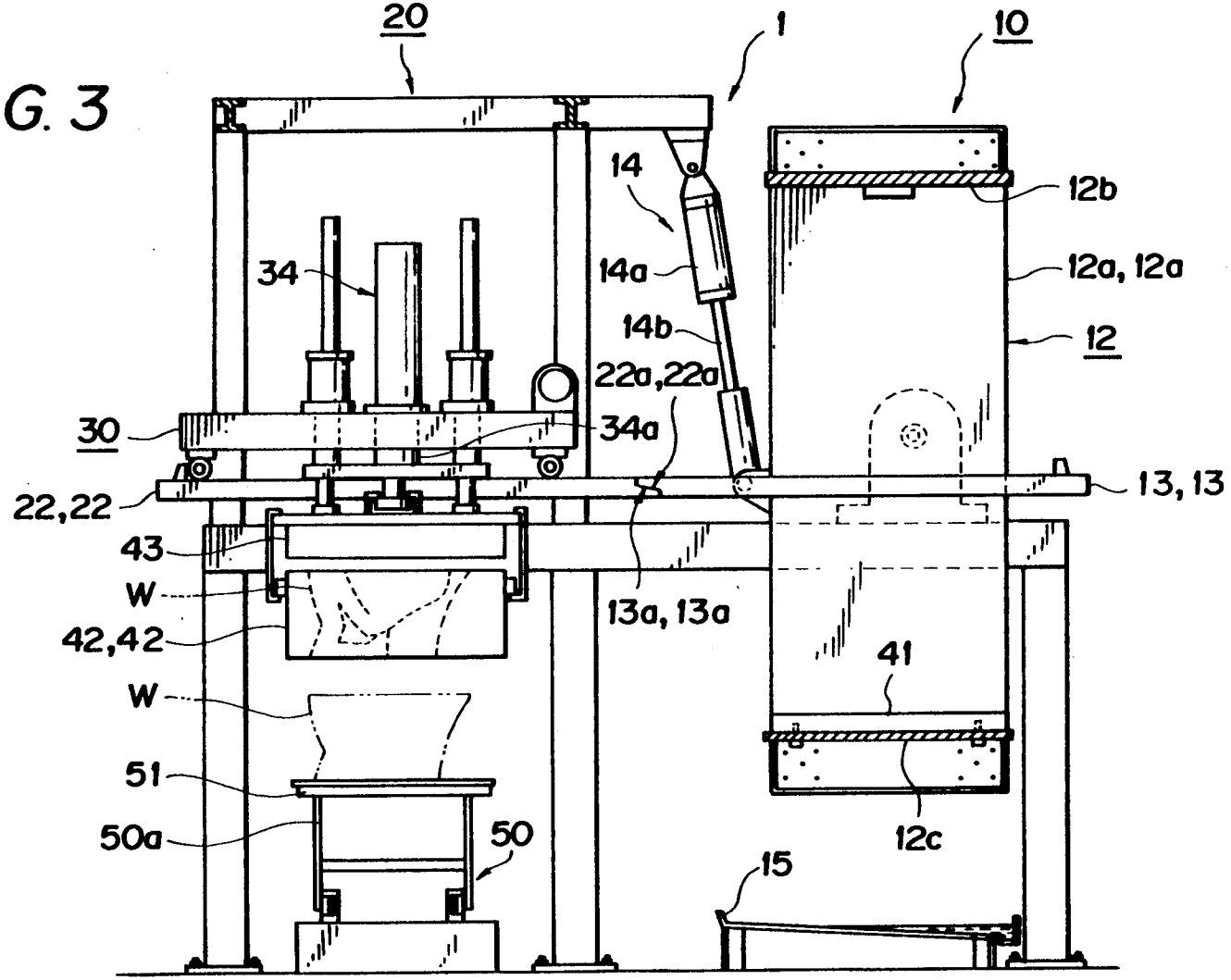
FIG. 3 is a front elevational view showing the manner in which the mold of the slip casting device shown in FIG. 1 is moved to a releasing station.

Then, while suspending the upper mold member 43, the side mold members 42, and the casting W, the carriage 30 travels on and along the first rails 13 and the second rails 22 to a predetermined position in the releasing station 20, as shown in FIG. 3.

After the carriage 30 has reached the predetermined position in the releasing station 20, the piston rod 34*a* of the cylinder unit 34 is extended to lower the upper mold member 43, the side mold members 42, and the casting W to a given vertical position. A setter 51 placed on the lifting mechanism 50*a* on the conveyor 50 is lifted until it abuts against the lower surface of the casting W, which is now supported on the setter 51.

While the casting W is being supported by the setter 51, the water passages in the side mold members 42 are supplied with air under pressure from the hoses T2. The water which has remained in the inner layers of the side mold members 42 is caused to ooze out into the interface between the casting W and the inner surface of the mold, thereby forming a water film. The water film now separates the side mold members 42 from the casting W. Thereafter, the side mold members 42 are moved away from the casting W in directions toward and away from the viewer of FIG. 3, by an opening and closing mechanism (not shown).

Subsequently, the casting W is lowered by the lifting mechanism 50*a* while it is being supported on the setter 51, and is then fed horizontally away from the viewer of FIG. 3 for further processing such as drying, for example.

The side mold members 42 are then moved toward each other and assembled together by the opening and closing mechanism. Thereafter, the piston rod 34*a* is contracted to lift the side mold members 42 and the upper mold member 43 to the vertical position shown in FIG. 3. The carriage 30 then travels on and along the rails 22, 13 into the center of the molding station 10. The piston rod 34*a* is extended to lower the upper mold member 43 and the side mold members 42.

In the molding station 10, the lower mold member 41 is in a standby condition. Therefore, when the mold members 43, 42 are moved downwardly by the piston rod 34*a*, the side mold members 42 are first placed on the lower mold member 41, and then the upper mold member 43 is placed on the side mold members 42. Now, the mold 40 as shown in FIG. 1 is substantially assembled.

The mold 40 is further clamped between the piston rod 34*a* and the horizontal panel 12*c* of the frame 12. The side mold members 42 are pressed together by respective horizontal cylinders, not shown. The above slip casting process is thereafter repeated.

In the slip casting device 1 described above, the molding station 10 and the releasing station 20 are horizontally spaced from each other. Therefore, the setter 51 which supports the lower surface of the casting W is not required to be carried into a position between the casting W and the lower mold member 41. Thus, it is not necessary to displace the side mold members 42 and the upper mold member 43, and the lower mold member 42 vertically away from each other over a long distance. Consequently, the vertical dimensions of the slip casting device 1 are minimized. Since the casting W is molded and released in different stations, the device components in the stations are spaced or scattered in the slip casting device 1, which is thus simplified in structure. Since the receptacle 15 is disposed in the lower portion of the molding station 10, water can easily be discharged during the molding process, and any arrangement including the receptacle 15 for discharging water and extra slip is relatively simple.

Since the first rails 13 and the second rails 22 are separable from each other, the frame 12 can be tilted and the mold 40 can also be tilted for the discharge of extra slip.

In the above embodiment, the carriage 30 is employed to move the mold 40 reciprocally between the molding station 10 and the releasing station 20. However, the mold 40 may be moved reciprocally between the stations 10, 20 by another means such as a robot arm or the like.

The mold 40 may be replaced with a mold of plaster or biscuit. The slip casting device 1 is particularly useful for carrying out the pressurized molding process.

Figure 4:
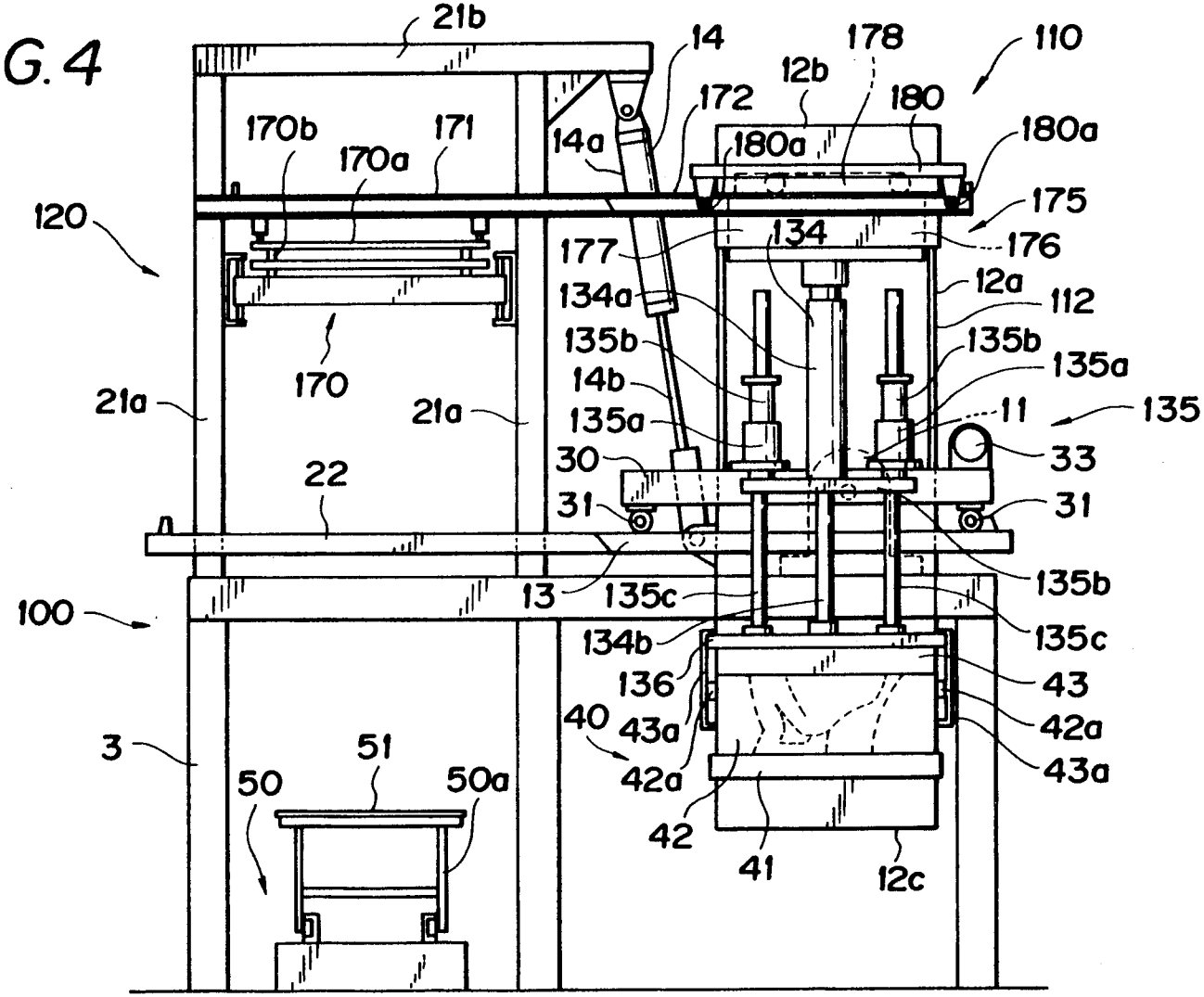
FIG. 4 is a front elevational view of a slip casting device according to a second embodiment of the present invention.
Figure 5:
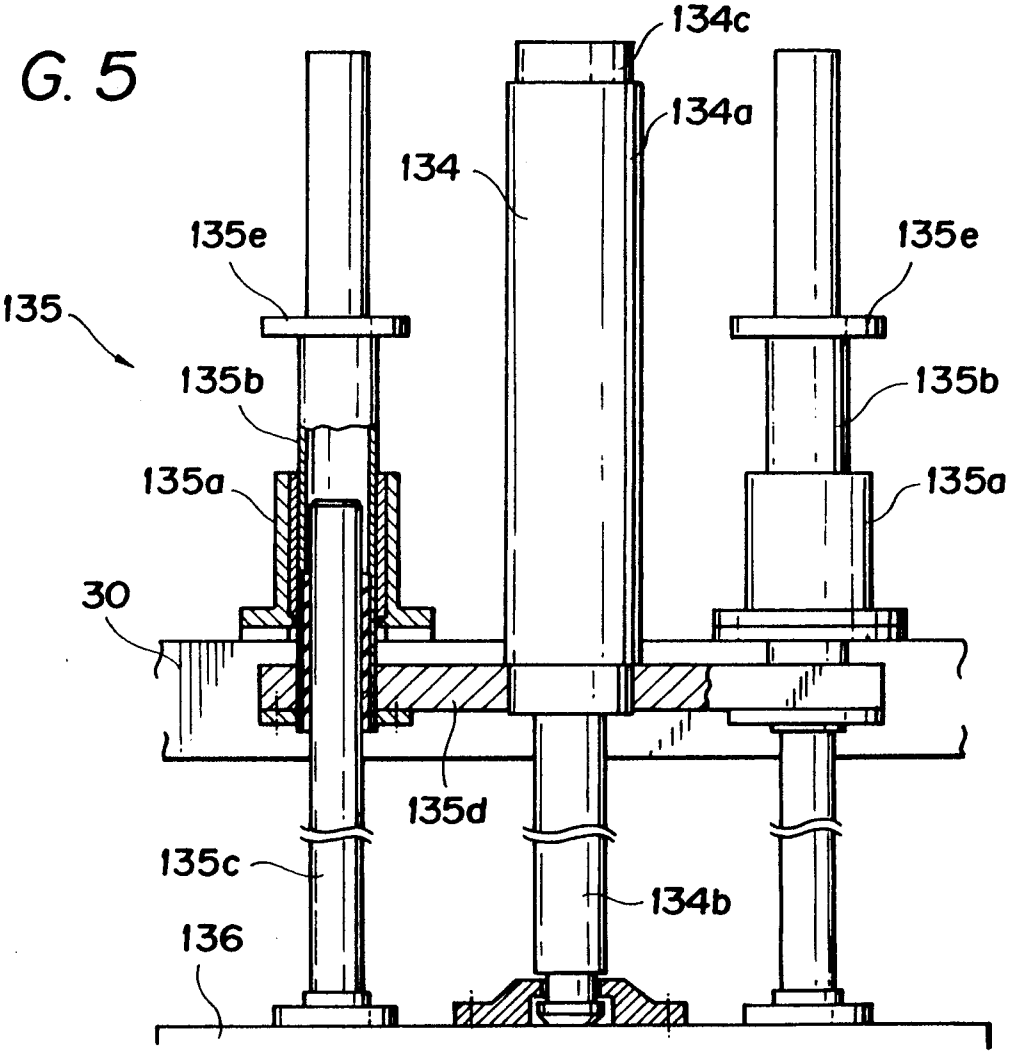
FIG. 5 is an enlarged front elevational view, partly in cross section, of a guide mechanism for a common mold clamping cylinder.

FIG. 4 shows a slip casting device 100 according to a second embodiment of the present invention. FIG. 5 shows, partly in cross section, a guide mechanism 135 for a common mold clamping cylinder in the slip casting device 100. Those components of the slip casting device 100 which are identical to those of the slip casting device 1 are denoted by identical reference numerals, and will not be described in detail. The slip casting device 100 is different from the slip casting device 1 in that the slip casting device 100 has an upper mold 175 in addition to the mold 40.

In FIG. 4, a molding station 110 and a releasing station 120 are horizontally spaced from each other. The table 3 supports a hanging conveyor 170 above the conveyor 50 in the releasing station 120. A frame 112 is supported on the table 3 in the molding station 110. The hanging conveyor 170 is disposed over the rails 22 between the upright members 21*a* and extends perpendicularly to the sheet of FIG. 4, and a plurality of movable setters 170*a* are vertically movably mounted on the hanging conveyor 170 through a lifting mechanism 170*b*. In the releasing station 120, castings are placed respectively on the setters 51, 170*a* which are fed by the respective conveyors 50, 170.

Between the upright members 21*a*, there extends a pair of upper fixed rails 171 above the hanging conveyor 170 parallel to the rails 22. As with the rails 22, the upper fixed rails 171 have righthand ends which are complementary in shape to the lefthand ends of rails 172 which are secured to the frame 112, so that these ends of the rails 171, 172 snugly engage each other.

The rails 172 are fixed to confronting inner surfaces of the vertical panels 12*a* of the frame 112. A holder 177 for holding a lower mold member 176 of the upper mold 175 vertically movably immediately below the rails 172 is fixed to the vertical panels 12*a*. Slip supply/discharge hoses connected to the molds 40, 175 are omitted from illustration in FIG. 4.

The lefthand ends (FIG. 4) of the rails 172 have slanted end surfaces which are complementarily connectable to the righthand ends of the fixed rails 171. When the frame 112 is tilted by the cylinder 14, the upper rails 172 and the lower rails 13 are tilted with the frame 112 respectively away from the upper and lower fixed rails 171, 22.

As shown in detail in FIG. 5, the guide mechanism 135 for a common mold clamping cylinder 134 is mounted on the carriage 30. The guide mechanism 135 has two horizontally spaced hollow guide posts 135*a* fixed to the carriage 30, and hollow cylindrical guide bushings 135*b* and guide rods 135*c* which are vertically slidably fitted concentrically in the hollow guide posts 135*a*.

The guide bushings 135*b* have respective lower ends fastened to a cylinder support 135*d* (first movable body) securely joined to a cylinder body 134*a* of the cylinder 134. The guide rods 135*c* have respective lower ends fastened to an upper mold member holder 136 (second movable body) of the mold 40. The guide rods 135*c* are slidably fitted respectively in the guide bushings 135*b*.

With the above arrangement, the cylinder support 135*d* is vertically movable with respect to the carriage 30 and the upper mold member holder 136.

The common mold clamping cylinder 134 has an extensible and contractable piston rod 134*b* extending downwardly from the lower end of the cylinder body 134*a*. The piston rod 134*b* has a lower end coupled to the upper mold member holder 136, and the cylinder body 134*a* has on its upper end a pusher 134*c* which can push a lower mold member 176 of the second mold 175 upwardly. A stopper 135*e* is fixed to the upper end of each of the guide bushings 135*b*. The lower mold 40 serves to mold the bowl of a flush toilet, whereas the upper mold 175 serves to mold the rim of the flush toilet. The upper mold 175 comprises the lower mold member 176 which is supported on a lower mold member holder 177, and an upper mold member 178 which is suspended from an upper carriage 180, the upper and lower mold members 178, 177 being vertically separable away from each other.

As with the lower carriage 30, the upper carriage 180 is self-propelled and has four wheels 180*a* and a motor (not shown) with a speed reducer. When the wheels 180*a* are driven by the motor, the upper carriage 180 runs on and along the upper rails 171, 172 in unison with the lower carriage 30. The wheels 180*a* of the upper carriage 180 are rollingly fitted in grooves defined in sides of the rails 171, 172, and can be moved upwardly when pushed upwardly by the mold clamping cylinder 134.

Operation of the slip casting device 100 will be described below.

The slip casting device 100 simultaneously molds the barrel portion and rim of a toilet bowl with the first (lower) and second (upper) molds 40, 175, respectively, in the molding station 110.

As shown in FIG. 4, when the piston rod 134*b* of the mold clamping cylinder 134 is extended, the side mold members 42 of the first mold 40 are placed on the lower mold member 41, and then the upper mold member 43 is placed on the side mold members 42. Upon further extension of the piston rod 134*b*, the first mold 40 is firmly clamped between the piston rod 134*b* and the horizontal panel 12*c*. Continued extension of the piston rod 134*b* applies an upward reactive force to the cylinder body 134*a*. Therefore, as shown in FIG. 5, the cylinder body 134*a* is lifted with respect to the lower carriage 30 while being guided by the cylinder support 135*d*, the guide bushings 135*b*, and the guide posts 135*a*. The pusher 134*c* on the upper end of the cylinder body 134*a* abuts against and pushes upwardly the lower mold member 176 of the second mold 175. When the lower mold member 176 is elevated to a certain position, the upward movement of the cylinder body 134*a* is limited by the lower mold member 176. Upon continued extension of the piston rod 134*b*, the first mold 40 and the second mold 175 are simultaneously clamped.

Then, the cylinder 14 is actuated to tilt the frame 112, thereby tilting the molds 40, 175. Now, a slip is poured into the mold cavities in the molds 40, 175 from the lowermost portions of the molds 40, 175.

Thereafter, the slip in the mold cavities is pressurized up to a pressure ranging from 5 through 10 atmospheric pressures by a pump or a pressure intensifier (not shown). Only the clay of the slip is built up on the inner surface of the inner layer of each of the molds 40, 175, thereby molding the bowl and rim of a flush toilet.

After elapse of a predetermined period of time, any extra slip is discharged under pressure from the mold cavities in the molds 40, 175.

The piston rod 14*b* of the cylinder 14 is continuously extended to return the frame 112 to the position shown in FIG. 4, and air under pressure is supplied into the water passages in the upper mold member 43 and the lower mold member 41 of the first mold 40 and also in the lower mold member 176 of the second mold 175. At the same time, the piston rod 134*b* of the mold clamping cylinder 134 is contracted. As a consequence, the lower mold member 41 and the upper mold member 43 of the first mold 40 are separated from the casting, and the side mold members 42 thereof are lifted while gripping the casting. The lower mod member 176 of the second mold 175 is lowered away from the casting, which is gripped by the upper mold member 178 of the second mold 175. Then, the lower carriage 30 and the upper carriage 180 run together toward the releasing station 120.

In the releasing station 120, the setter 51 on the conveyor 50 ascends until it abuts against the lower surface of the casting in the first mold 40, and the setters 170*a* on the conveyor 170 ascend until they abut against the lower surface of the casting in the second mold 175. Thereafter, air under pressure is supplied into the water passages in the side mold members 42 of the first mold 40, separating the side mold members 42 from the casting. The side mold members 42 are laterally spaced from each other, leaving the casting on the setter 51.

Likewise, air under pressure is supplied into the water passage in the upper mold member 178 of the second mold 175, separating the upper mold member 178 from the casting which is placed on the setters 170*a*. The castings on the setters 50, 170*a* are then fed by the conveyors 50, 170, respectively, for further processing.

After the castings have been removed, the carriages 30, 180 are moved to the right in FIG. 4 back into the molding station 110. In the molding station 110, the molds 40, 175 are assembled again, and the above slip casting process is repeated again.

In the slip casting device 100, since the two molds 40, 175 are disposed in upper and lower positions on the common frame 112, it is possible to manufacture desired shaped sanitary ceramic products at a higher rate without involving an increase in the space taken up by the slip casting device 100. Inasmuch as the two molds 40, 175 are clamped by the single common mold clamping cylinder 134, the height of the slip casting device 100 is prevented from being unduly large.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. A slip casting device comprising:

slip casting mold means including a plurality of mold members;

molding station means for flowing a slip into said mold means, discharging water in the slip, and building up clay of the slip on a molding surface of the mold to form at least one casting;

at least one of said mold members being adapted to carry said casting formed in said mold means away from said molding station means;

releasing station means for finally separating the casting from said mold members which carry said casting;

said molding stations means and releasing station means being disposed at separate locations;

means for reciprocally moving said mold members which carry the casting between said separate locations;

said mold means comprising a lower mold for forming a first casting and an upper mold for forming a second casting;

a frame on which said lower mold and said upper mold are mounted in vertically spaced relation to each other; and a common mold clamping cylinder disposed between said lower mold and said upper mold so that lower mold is clamped between one end of said clamping cylinder and a lower portion of said frame, and said upper mold is clamped between the other end of said clamping cylinder and an upper portion of said frame.

2. A slip casting device comprising:

a lower slip casting mold including upper and lower mating mold members;

an upper slip casting mold including upper and lower mating mold members;

a frame on which said lower mold and said upper mold are mounted in vertically spaced relation to each other;

said lower member of the upper mold being vertically movably supported by an upper portion of said frame, and said lower member of said lower mold being fixed to a lower portion of said frame;

a movable carriage means for movably supporting the upper members of said upper and lower molds and having said upper member of the lower mold and said upper member of the upper mold mounted thereto; and a common mold clamping cylinder disposed on said carriage means vertically between said upper member of said lower mold and said lower member of the upper mold for moving these members against their mating members.

3. A slip casting device comprising:

a slip casting mold including a plurality of mold members;

molding station means for flowing a slip into said mold, for discharging water in the slip, and building up clay of the sip on molding surfaces of the mold to form a casting;

at least one of said mold members being adapted to carry said casting formed in said mold away from said molding station means;

releasing station means for finally separating said casting from said mold members and which carry the casting;

said molding station means and said releasing station means being disposed at separate locations;

rail means extending between said molding station means and said releasing station means;

carriage means for carrying said mold members horizontally along said rail means;

said molding station means including a frame;

a mold clamping cylinder connected to said carriage means and interposable between said molding station frame and said mold for clamping said mold members together in a closed position thereof;

said rail means including first rails fixed to said frame of said molding station means and second rails fixed to said releasing station means; and means for tilting said first rails relative to said second rails.

* * * * *

UNITED STATES PATENT AND TRADEMARK OFFICE

CERTIFICATE OF CORRECTION

PATENT NO. : 5,120,211

DATED : June 9, 1992

INVENTOR(S) : Haruyuki Ito; Masanobu Hisaeda; Toshiaki Sasaki; Yasuo Hirakawa; and Mitsuru Ida

It is certified that error appears in the above-identified patent and that said Letters Patent is hereby corrected as shown below:

Column 3, line 49, change "rod-34a" to -- rod 34a --.
Column 8, line 54, change "passage" to -- passages --.
Column 10, line 25 (Claim 3, line 6), change "sip" to -- slip --;
line 31 (Claim 3, line 12), delete "and".

Signed and Sealed this

Thirty-first Day of August, 1993

Bruce Lehman

*Attest:*

BRUCE LEHMAN

*Attesting Officer*

*Commissioner of Patents and Trademarks*